US009908332B2

(12) United States Patent
Ge et al.

(10) Patent No.: US 9,908,332 B2
(45) Date of Patent: Mar. 6, 2018

(54) INK PROPERTY SENSING ON A PRINTHEAD

(71) Applicant: HEWLETT-PACKARD DEVELOPMENT COMPANY, L.P., Houston, TX (US)

(72) Inventors: Ning Ge, Palo Alto, CA (US); Adam L. Ghozeil, Corvallis, OR (US); Chaw Sing Ho, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 48 days.

(21) Appl. No.: 15/114,967

(22) PCT Filed: Jan. 31, 2014

(86) PCT No.: PCT/US2014/013968

§ 371 (c)(1),
(2) Date: Jul. 28, 2016

(87) PCT Pub. No.: WO2015/116121

PCT Pub. Date: Aug. 6, 2015

(65) Prior Publication Data

US 2016/0339696 A1 Nov. 24, 2016

(51) Int. Cl.

| | |
|---|---|
| ***B41J 2/14*** | (2006.01) |
| ***B41J 2/175*** | (2006.01) |
| ***B41J 2/195*** | (2006.01) |
| *B41J 29/38* | (2006.01) |

(52) U.S. Cl.

CPC ..... *B41J 2/1433* (2013.01); *B41J 2/14153* (2013.01); *B41J 2/17566* (2013.01); *B41J 2/195* (2013.01); *B41J 29/38* (2013.01); *B41J 2002/14354* (2013.01); *B41J 2202/13* (2013.01)

(58) Field of Classification Search

CPC .. B41J 2/1433; B41J 2/14153; B41J 2/17566; B41J 2/195; B41J 2002/14354; B41J 2202/13; B01L 3/502715

See application file for complete search history.

(56) References Cited

U.S. PATENT DOCUMENTS

| | | | | |
|---|---|---|---|---|
| 6,007,188 | A | 12/1999 | MacLeod | |
| 6,557,974 | B1 | 5/2003 | Weber | |
| 7,922,274 | B2 | 4/2011 | Kubota et al. | |
| 2002/0003551 | A1 | 1/2002 | Beck | |
| 2008/0024565 | A1 | 1/2008 | Smith | |
| 2013/0280813 | A1 | 10/2013 | Rothberg et al. | |
| 2015/0330941 | A1 * | 11/2015 | Smith | H01L 29/786 257/253 |

* cited by examiner

*Primary Examiner* — Thinh H Nguyen
(74) *Attorney, Agent, or Firm* — HP Inc. Patent Department

(57) ABSTRACT

Ink property sensing on a printhead is described. In an example, a substrate for a printhead includes a cap layer having bores. Chambers are formed beneath the cap layer in fluidic communication with the bores. Fluid ejectors are disposed in at least a portion of the chambers. At least one ion-sensitive field effect transistor (ISFET) is disposed in a respective at least one of the chambers. An electrode is disposed in each of the chambers having an ISFET and capacitively coupled to said ISFET through a dielectric.

13 Claims, 7 Drawing Sheets

114

114

114

INK PROPERTY SENSING ON A PRINTHEAD

BACKGROUND

Inkjet technology is widely used for precisely and rapidly dispensing small quantities of fluid. Inkjets eject droplets of fluid out of a nozzle by creating a short pulse of high pressure within a firing chamber. During printing, this ejection process can repeat thousands of times per second. Inkjet printing devices are implemented using semiconductor devices, such as thermal inkjet (TIJ) devices or piezoelectric inkjet (PIJ) devices. For example, a TIJ device is a semiconductor device including a heating element (e.g., resistor) in the firing chamber along with other integrated circuitry. To eject a droplet, an electrical current is passed through the heating element. As the heating element generates heat, a small portion of the fluid within the firing chamber is vaporized. The vapor rapidly expands forcing a small droplet out of the firing chamber and nozzle. The electrical current is then turned off and the heating element cools. The vapor bubble rapidly collapses, drawing more fluid into the firing chamber.

BRIEF DESCRIPTION OF THE DRAWINGS

Some embodiments of the invention are described with respect to the following figures.

DETAILED DESCRIPTION

Ink property sensing on a printhead is described. In an example, a substrate for a printhead includes a cap layer having bores. Chambers are formed beneath the cap layer in fluidic communication with the bores. Fluid ejectors are disposed in at least a portion of the chambers. At least one ion-sensitive field effect transistor (ISFET) is disposed in a respective at least one of the chambers. An electrode is disposed in each of the chambers having an ISFET and capacitively coupled to said ISFET through a dielectric. The ISFET can be configured to be responsive to particular ion concentrations in the ink, such as pH. As the ink properties change over time, such as changing pH, the changes can be detected as shifts in the threshold voltage of the ISFET.

Figure 1:
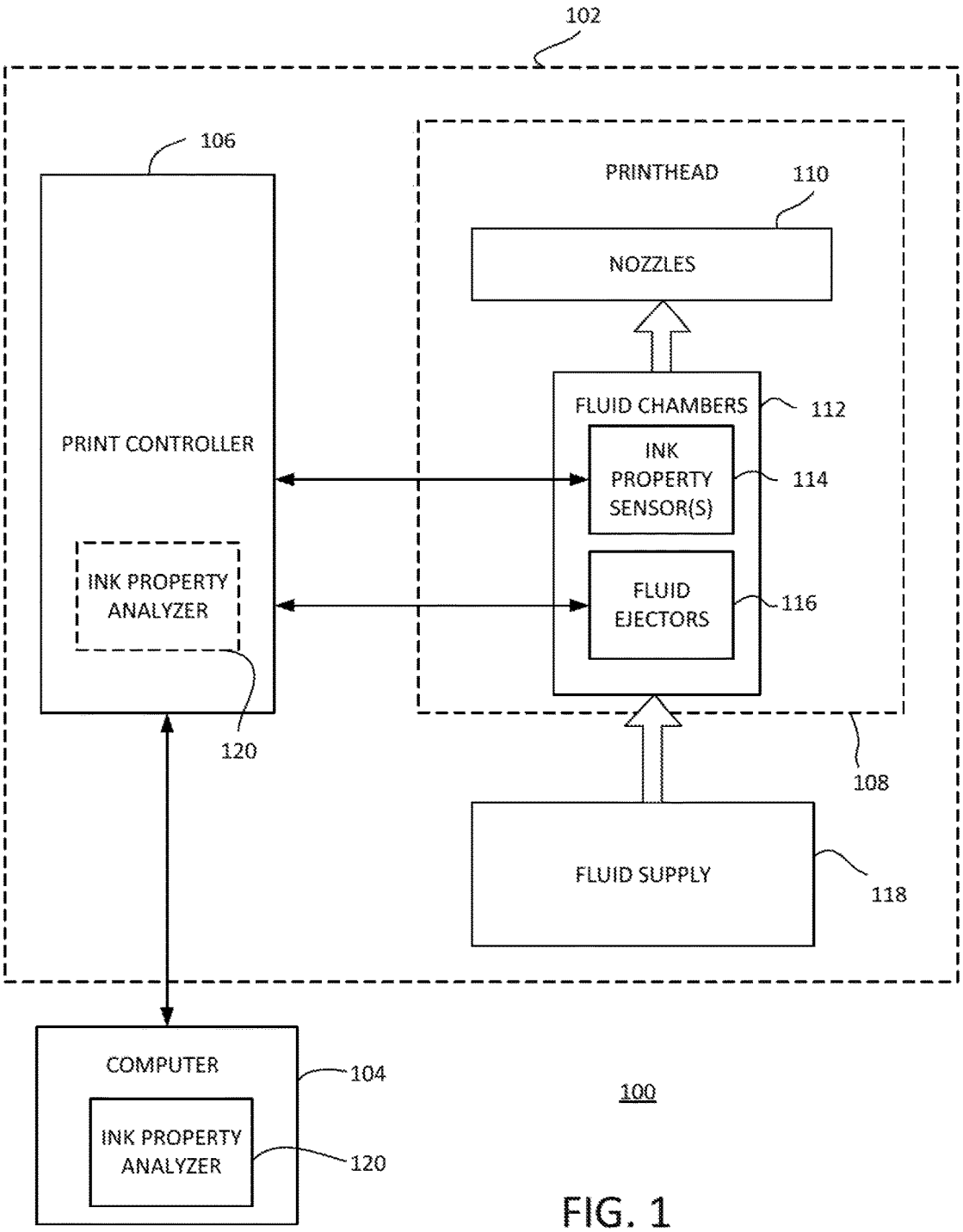
FIG. 1 is a block diagram depicting a printing system according to an example implementation.

FIG. 1 is a block diagram depicting a printing system 100 according to an example implementation. The printing system 100 includes at least a printer 102. In some examples, the printer 102 can be coupled to a computer 104. The printer 102 includes a print controller 106 and a printhead 108. The printhead 108 is in fluidic communication with a fluid supply 118. In some examples, the printhead 108 and the fluid supply 118 are a single unit or integrated printhead (IPH). In other examples, the fluid supply 118 can be a separate unit from the printhead 108. The fluid supply 118 provides ink to the printhead 108.

The printhead 108 includes nozzles 110 and fluid chambers 112. The fluid chambers 112 are in fluidic communication with the nozzles 110. The fluid chambers 112 include ink property sensor(s) 114 and fluid ejectors 116. The fluid ejectors 116 are disposed in at least a portion of the fluid chambers 112. Each of the ink property sensor(s) 114 can be disposed in a fluid chamber 112 that also has a fluid ejector 116, or in a fluid chamber by itself without a fluid ejector 116. The ink property sensor(s) 114 and the fluid ejectors 116 are electrically coupled to the print controller 106. The print controller 106 drives the fluid ejectors 116 to eject ink from respective fluid chambers 112 through respective nozzles 110 onto media (not shown). The print controller 106 also drives the ink property sensor(s) 114 and obtains measurements from the ink property sensor(s) 114.

Each of the ink property sensor(s) 114 is configured for electrochemical detection of ion concentration in the ink. Ion concentration measurements can be used to determine various properties of the ink. For example, the ink property sensor(s) 114 can measure pH of the ink, where pH is a measure of the activity of solvated hydrogen ions. The pH range of ink in a printhead as the ink ages and is used over time can vary. For example, the pH range for some inks can range from 8.5 down to 5.5, where pH 7.0 is neutral. The change in pH versus percentage change in weight loss can vary for different inks depending on the particular ion combination for the ink solution. Different ion combinations are present in different colors and kinds of ink.

In operation, the print controller 106 can drive the ink property sensor(s) 114 to measure ink ion concentration. The print controller 106 obtains samples of electrical output from the ink property sensor(s) 114 representative of ink ion concentration. In an example, the print controller 106 provides the samples to the computer 104. The computer 104 can include an ink property analyzer 120 implemented using software, hardware, or a combination thereof. The ink property analyzer 120 can analyze the electrical samples and derive ink properties therefrom. In some examples, the functionality of the ink property analyzer 120 can be implemented in the print controller 106 rather than the computer 104.

Figure 2A:
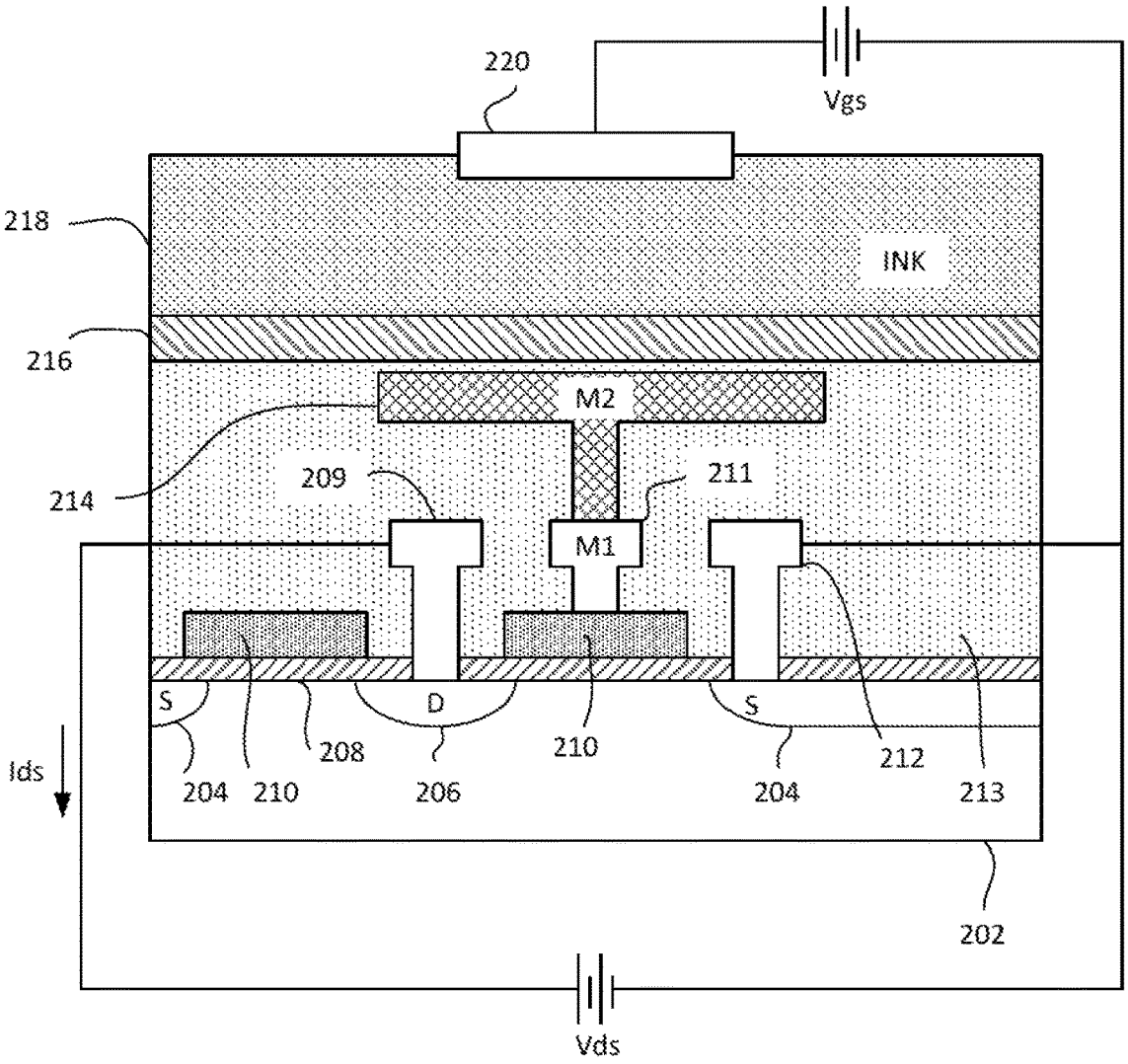
FIGS. 2A and 2B are cross-section diagrams showing an ink property sensor according to example implementations.
Figure 2B:
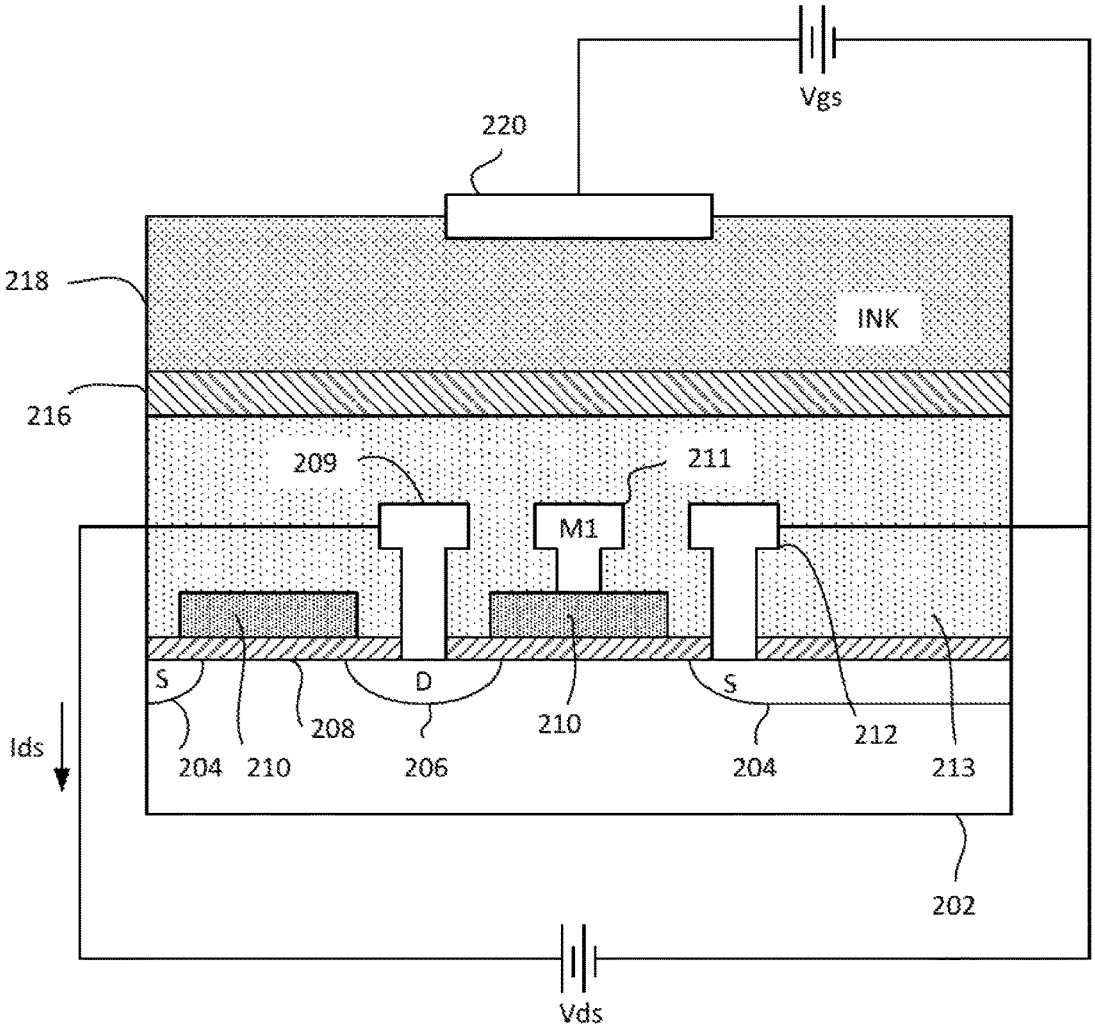

FIGS. 2A and 2B are cross-section diagrams showing an ink property sensor 114 according to example implementations. In general, the ink property sensor 114 includes a silicon substrate 202 having diffusion regions 204 and 206. In an example, field oxide is not used to isolate transistors. Rather, polysilicon is patterned and used as a mask to selectively diffuse regions in the substrate 202. Hence, a transistor can include a polysilicon ring separating one diffusion region from another. It is to be understood that such a structure is one example and that other examples can include substrates having traditional field oxide separating diffusion regions.

In an example, the ink property sensor 114 is implemented using N-type metal-oxide semiconductor (NMOS) logic such that the substrate 102 comprises a P-type substrate and the diffusion regions 204 and 206 comprise N+ doped regions. For purposes of clarity, NMOS logic is assumed to be used for implementing the ink property sensor 114. It is to be understood that the ink property sensor 114 can be implemented using P-type metal-oxide semiconductor (PMOS) logic or complementary metal oxide semiconductor (CMOS) logic. In the case of PMOS logic, the substrate 202 comprises N-type silicon and the diffusion regions 204 and 206 comprise P+ doped regions. The configuration for N-wells in N-well CMOS logic are similar to the PMOS configuration, and the configuration for P-wells in P-well CMOS logic are similar to the NMOS configuration.

A gate oxide layer 208 is formed on the substrate 202. The gate oxide layer 208 can comprise a dielectric oxide material, such as silicon dioxide ($SiO_2$), a high-k dielectric material, such as halflium oxide ($HfO_2$) or aluminum oxide ($Al_2O_3$), or the like. A polysilicon layer is formed and patterned over the gate oxide layer 208 resulting in formation of the polysilicon region 210 between the diffusion regions 204 and 206. A first metal layer (M1) is formed and patterned over the polysilicon layer resulting in formation of M1 regions 209, 211, and 212 that are in electrical contact with the diffusion region 206, the polysilicon region 210, and the diffusion region 204, respectively. In an example, as shown in FIG. 2A, a second metal layer (M2) is formed and patterned over M1 resulting in formation of M2 region 214 that is in electrical contact with the M1 region 211. A dielectric material 213 generally isolates M2, M1, and the polysilicon layers from each other with exception of the specific electrical contacts described above. The dielectric material 213 can comprise, for example, silicon dioxide. A dielectric layer 216 is formed on the dielectric 213 over the metal layer 214. The dielectric layer 216 can comprise different material depending on the ions being sensed by the ink property sensor 114. For example, for sensing pH, the dielectric layer 216 can comprise silicon nitride ($Si_3N_4$) or silicon carbide (SiC) or the combination.

In another example, as shown in FIG. 2B, only the M1 layer may be formed below the dielectric layer 216. In such an example, an M2 layer may be formed on top of the dielectric layer 216 and can be used to implement the electrode 220, as described below.

Together, the polysilicon 210 and the respective portions of the metal layers 212 and 214 in electrical contact therewith comprise a "floating-gate" of metal-oxide field effect transistor (MOSFET) having the source 204 and the drain 206 (assuming N-MOS). Together with the dielectric layer 216, the MOSFET is an ion-sensitive FET or "ISFET". For purposes of clarity by example, two metal layers M1 and M2 are shown. It is to be understood that the ink property sensor 114 can be formed using more or less than 2 metal layers. The metal layer(s) can comprise any metal or metal alloy (e.g., Aluminum (Al), Aluminum copper (AlCu), Tantalum aluminum (TaAl), etc.).

The dielectric layer 216 contacts ink 218. An electrode 220 is also disposed to be in electrical contact with the ink 218. The electrode 220 is also capacitively coupled with the floating-gate of the FET (e.g., the portion of the metal layer 214 forming the floating-gate) through the ink 218, the dielectric 216, and the dielectric 213. The electrode 220 can comprises any metal or metal alloy. Specific examples of the electrode 220 are described below.

In operation, the source 204 is coupled to a reference voltage (e.g., electrical ground) and a voltage is applied to the electrode 220. The electrode 220 essentially acts as the reference gate of the ISFET. The voltage between the electrode 220 and the source 204 is the gate-to-source voltage, referred to as Vgs. The charge distribution for the ISFET will change according to the ion concentration in the ink. As the charge distribution changes, the threshold voltage of the ISFET changes. For example, if the ink property sensor 114 is configured to measure pH, then the ISFET's threshold voltage depends on the pH of the ink in contact with the dielectric 216. Change in the threshold voltage of the ISFET can be measured by measuring change in drain-to-source current (Ids) for a particular drain-to-source voltage (Vds). In general, materials for the electrode 220 and the dielectric 216 can be selected such that the threshold voltage of the ISFET changes over time in response to changes in a particular ion combination (pH described herein by way of example). Changes in the threshold voltage are detected through measurements of drain-to-source current given a particular drain-to-source voltage.

Figure 3:
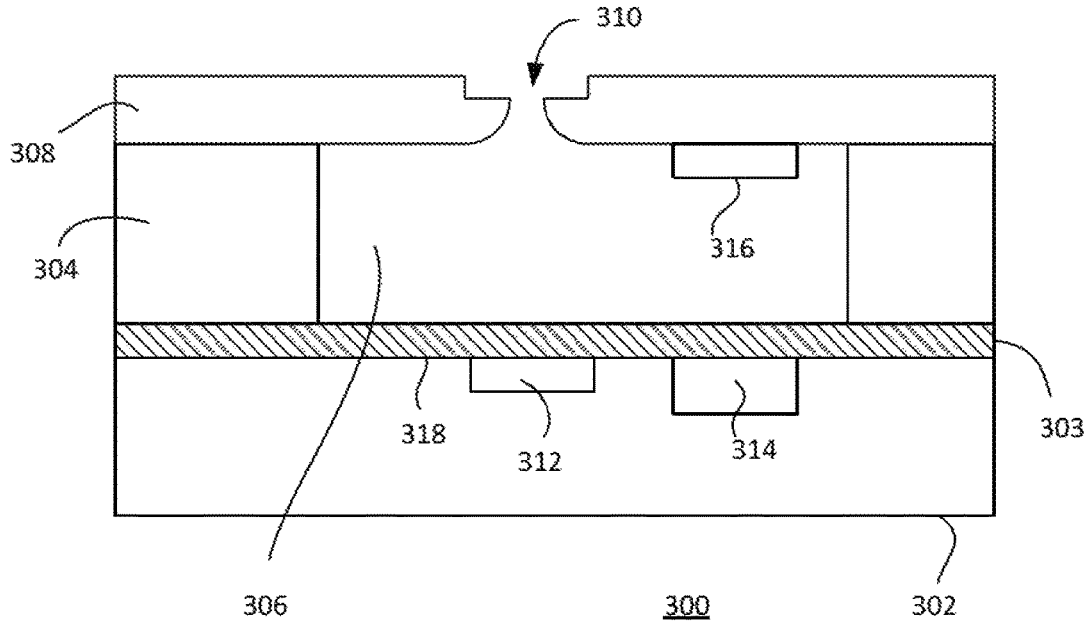
FIG. 3 is a cross-section diagram depicting a portion of the printhead according to an example implementation.

FIG. 3 is a cross-section diagram depicting a portion 300 of the printhead 108 according to an example implementation. The printhead portion 300 includes a substrate 302, a passivation layer 303, a barrier layer 304, and a cap layer 308 (also referred to as an orifice plate 308). The barrier layer 304 includes a chamber 306 formed therein. The barrier layer 304 can comprise a polymeric material (e.g., SU8). The orifice plate 308 includes a bore 310 formed therein (also referred to as a nozzle 310). The orifice plate 308 can be metal or a polymeric material (e.g., SU8). The chamber 308 is in fluidic communication with the nozzle 310. In some examples, a fluid ejector 312 is disposed on the substrate 302 in the chamber 308 and under the passivation layer 303 (e.g., a resistor in a thermal inkjet (TIJ) device). An ink property sensor is also disposed in the chamber 306 comprising an ISFET 314 and an electrode 316. The electrode 316 is formed on the orifice plate 308 over the ISFET 314. The electrode 316 is capacitively coupled to the ISFET 314 through ink in the chamber 306 and the passivation layer 303. In some examples, the ink property sensor 314, 316 can be disposed in a chamber 306 that does not contain a fluid ejector 312. The details of the ISFET are shown and described with respect to FIG. 2, where the passivation layer 303 can be the dielectric layer 216.

In an example, the orifice plate 308 is metal and the electrode 316 is formed as a protrusion of the orifice plate 308. In such case, the orifice plate 308 and the electrode 316 may comprise nickel (Ni) with a palladium (Pa) or Titanium (Ti) coating, for example. In another example, the orifice plate 308 may be polymeric and the electrode 316 may be embedded in the polymer material. In such case, the electrode 316 may comprise TaAl, for example.

Figure 4A:
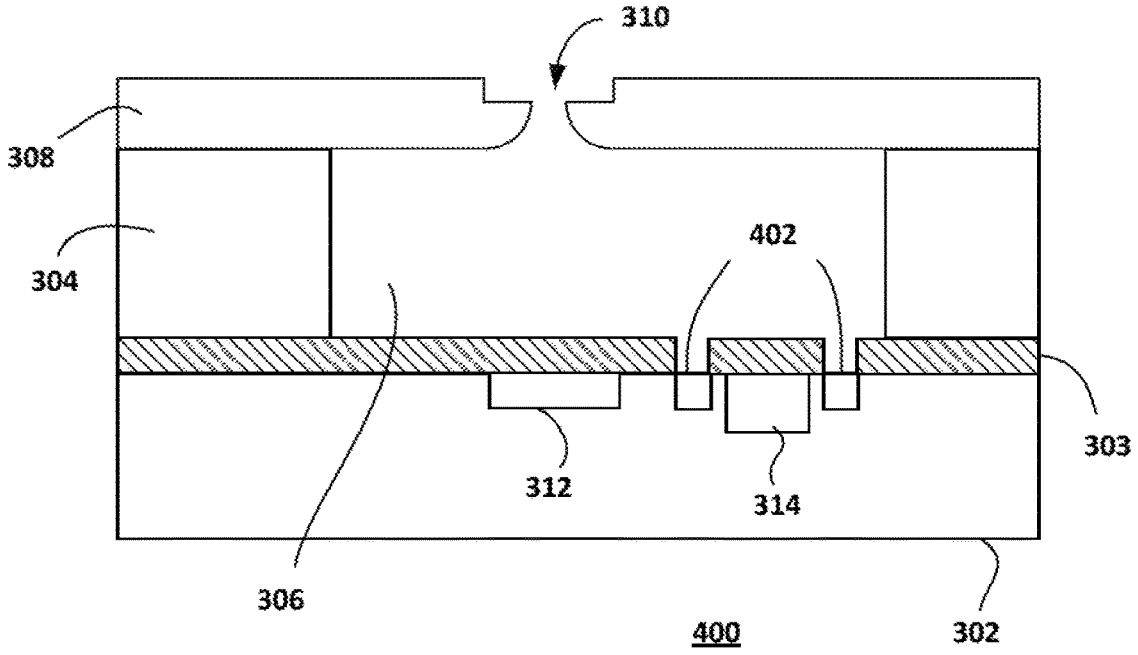
FIGS. 4A and 4B are cross-section diagrams depicting portions of the printhead according to example implementations.

FIG. 4A is a cross-section diagram depicting a portion 400 of the printhead 108 according to an example implementation. Elements of FIG. 4A that are the same or similar to those of FIG. 3 are designated with identical reference numerals. In the present example, the ink property sensor includes an electrode 402 arranged around the ISFET 314. The electrode 402 contacts the ink through openings of the passivation layer 303. The electrode 402 is capacitively coupled to the ISFET 314 through ink in the chamber 306 and the passivation layer 303 in a horizontal direction. In some examples, the ink property sensor 314, 316 can be disposed in a chamber 306 that does not contain a fluid ejector 312. The details of the ISFET are shown and described with respect to FIG. 2, where the passivation layer 303 can be the dielectric layer 216.

Figure 4B:
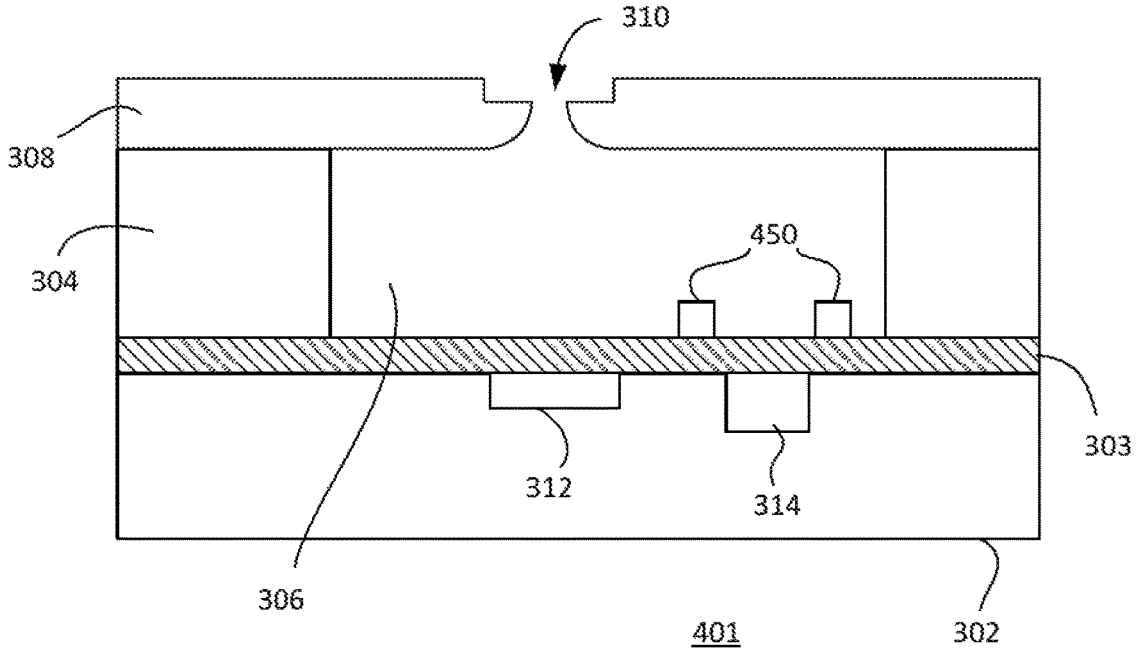

FIG. 4B is a cross-section diagram depicting a portion 401 of the printhead 108 according to an example implementation. Elements of FIG. 4B that are the same or similar to those of FIGS. 3 and 4A are designated with identical reference numerals. In the present example, the ink property sensor includes an electrode 450 arranged around the ISFET 314 and formed on the passivation layer 303. The electrode 450 is capacitively coupled to the ISFET 314 through ink in the chamber 306 and the passivation layer 303 in a vertical direction. In some examples, the ink property sensor 314, 316 can be disposed in a chamber 306 that does not contain a fluid ejector 312. The details of the ISFET are shown and described with respect to FIG. 2, where the passivation layer 303 can be the dielectric layer 216.

Figure 5:
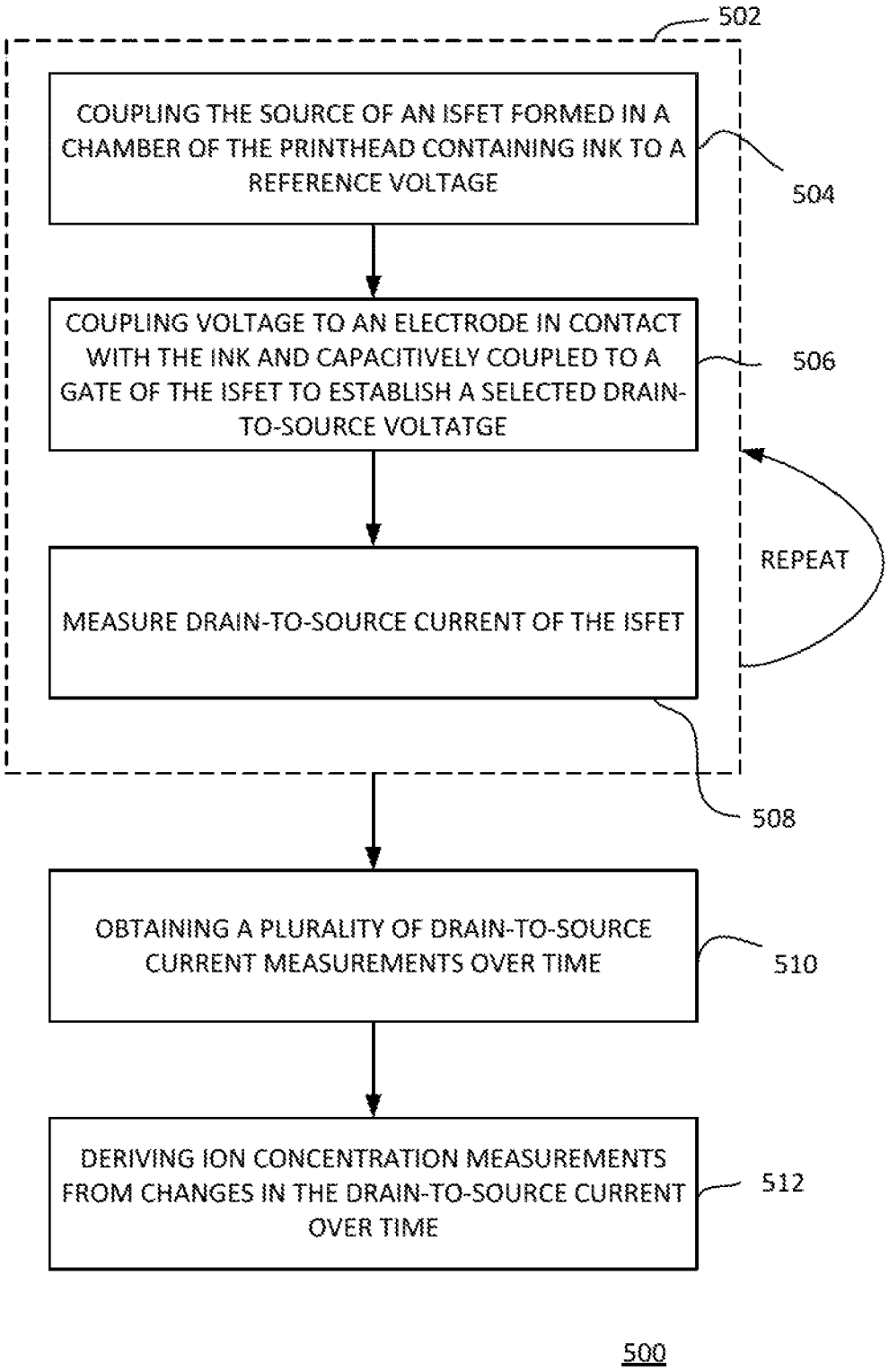
FIG. 5 is a flow diagram depicting a method of sensing ink properties according to an example implementation.

FIG. 5 is a flow diagram depicting a method 500 of sensing ink properties according to an example implementation. The method 500 can be performed by the print controller 106 shown in FIG. 1 with or without cooperation of the computer 104. The method 500 begins with execution of a sub-method 502. The sub-method 502 begins at step 504, where the source of an ISFET formed in a chamber of the printhead containing ink is coupled to a reference voltage (e.g., electrical ground). At step 506, a voltage is coupled to an electrode in contact with the ink and capacitively coupled to a gate of the ISFET to establish a selected drain-to-source voltage. At step 508, the drain-to-source current is measured. The sub-method 500 can be repeated for a plurality of iterations over time. At step 510, a plurality of drain-to-source current measurements is obtained over time. At step 512, ion concentration measurements are derived from changes in the drain-to-source current over time.

Figure 6:
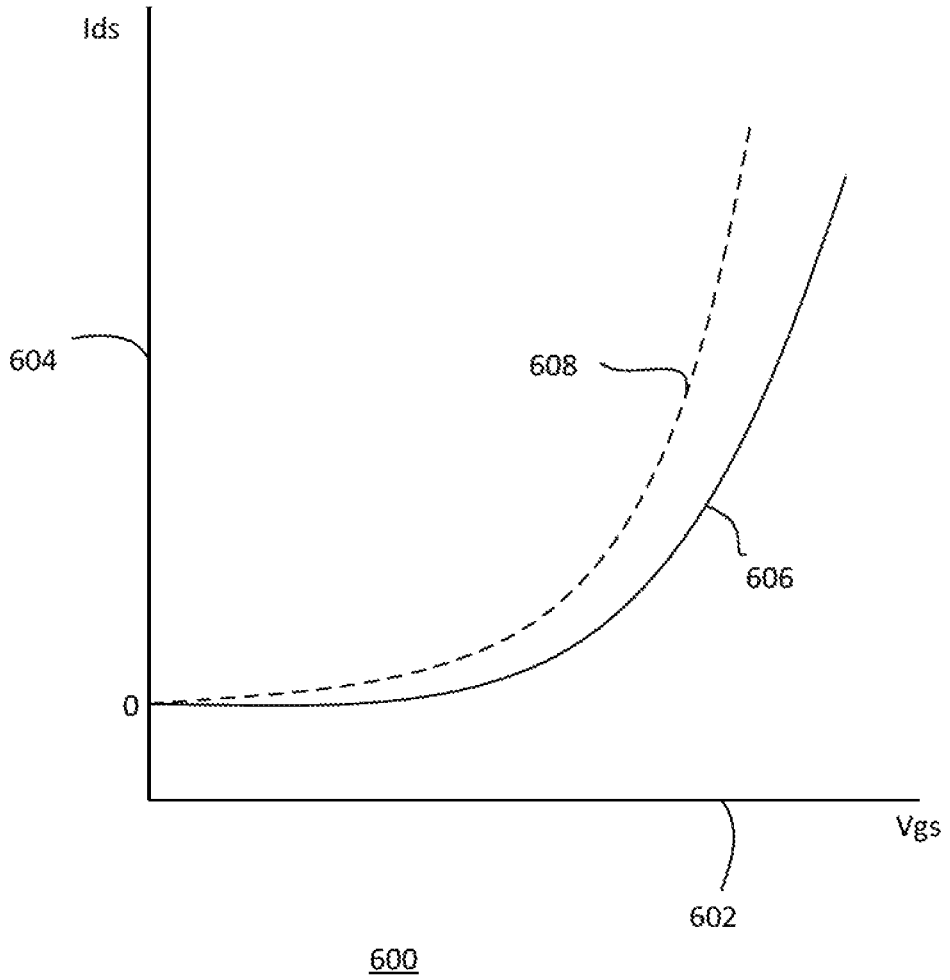
FIG. 6 is a graph depicting relationships between drain current and gate voltage for different ink pH values for a given drain-to-source voltage according to an example implementation.

FIG. 6 is a graph 600 depicting relationships between drain current and gate voltage for different ink pH values for a given drain-to-source voltage according to an example implementation. The graph 600 includes an x-axis 602 representing gate voltage (gate-to-source voltage), and a y-axis 604 representing drain current (drain-to-source current). A response curve 606 shows a relationship between drain current and gate voltage obtained at a first measurement time. A response curve 608 shows a relationship between drain current and gate voltage obtained at a second measurement time. The response curves 606 and 608 show that the drain current increases as measurements are taken over time. An increase in drain current for a particular drain-to-source voltage indicates that the threshold voltage of the ISFET has decreased due to a corresponding decrease in pH of the ink. Relationships as shown in the graph 600 can be determined experimentally for particular ion concentrations and inks and stored by the print controller 106 and/or computer 104 for use in deriving ion concentration as described above in the method 500.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A substrate for a printhead, comprising:

a cap layer having bores;

chambers formed beneath the cap layer in fluidic communication with the bores;

fluid ejectors disposed in at least a portion of the chambers;

at least one ion-sensitive field effect transistor (ISFET) disposed in a respective at least one of the chambers; and an electrode disposed in each of the chambers having an ISFET and capacitively coupled to said ISFET through a dielectric.

2. The substrate of claim 1, wherein each ISFET comprises:

source and drain diffusion regions in the substrate;

a gate region patterned using at least one conductive layer formed on the substrate; and wherein the dielectric includes at least one dielectric layer electrically isolating the gate region from the respective chamber.

3. The substrate of claim 2, wherein the at least one conductive layer includes a polysilicon layer and at least one metal layer.

4. The substrate of claim 2, wherein the gate region includes a metal region formed in a top-most conductive layer of the at least one conductive layer, the metal region being capacitively coupled with the respective electrode.

5. The substrate of claim 1, wherein each electrode is formed on the cap layer above the respective ISFET.

6. The substrate of claim 2, wherein each electrode is formed on the dielectric surrounding the ISFET.

7. A printhead, comprising:

a plurality of nozzles formed in an orifice plate;

a plurality of chambers formed in a barrier layer beneath the orifice plate, the plurality of chambers being in fluidic communication with the plurality of nozzles;

ink ejectors disposed in at least a portion of the plurality of chambers; and at least one ink property sensor disposed in a respective at least one of the plurality of chambers, each ink property sensor comprising an ion-sensitive field effect transistor (ISFET) capacitively coupled to an electrode through a dielectric.

8. The printhead of claim 7, wherein the ISFET of each ink property sensor comprises a floating-gate capacitively coupled to the respective electrode through at least one layer of the respective dielectric.

9. The printhead of claim 7, wherein the electrode of each ink property sensor is formed on the orifice plate above the respective ISFET.

10. The printhead of claim 7, wherein the electrode of each ink property sensor is formed on the respective dielectric surrounding the respective ISFET.

11. A method of sensing ink properties on a printhead, comprising:

coupling a source of an ion-sensitive field effect transistor (ISFET) formed in a chamber of the printhead containing ink to a reference voltage;

coupling a voltage to an electrode in contact with the ink in the chamber, where the electrode is capacitively coupled to a gate of the ISFET and the voltage is selected to establish a selected voltage between a drain and the source of the ISFET; and measuring drain-to-source current of the ISFET.

12. The method of claim 11, further comprising:

obtaining measurements of the drain-to-source current over a plurality of iterations; and measuring changes in the drain-to-source current over the plurality of iterations.

13. The method of claim 12, further comprising:

deriving on concentration measurements from the changes in the drain-to-source current over the plurality of iterations.

* * * * *